US005125657A

United States Patent [19]

Beil

[11] Patent Number: 5,125,657

[45] Date of Patent: Jun. 30, 1992

[54] PUTTER WITH PENDULUM ACTION

[75] Inventor: Richard D. Beil, 8248 Stoneham Dr., Ypsilanti, Mich. 48197

[73] Assignee: Richard D. Beil, Ypsilanti, Mich.

[21] Appl. No.: 696,158

[22] Filed: May 6, 1991

[51] Int. Cl.[5] ..... A63B 53/00

[52] U.S. Cl. ..... 273/77 R; 273/162 R; 273/81 D; 273/81.3; 273/81.4; 273/80 R; 273/164

[58] Field of Search ..... 273/162 R, 162 F, 81.4, 273/165, 194 R, 194 A, 194 B, 193 R, 193 A, 193 B, 81.3, 75

[56] References Cited

U.S. PATENT DOCUMENTS

| | | | |
|---|---|---|---|
| 2,094,766 | 10/1937 | Costello | 273/193 |
| 2,132,219 | 10/1938 | Pirie | 273/81.3 |
| 2,739,331 | 3/1956 | Goodman | 273/162 F X |
| 2,801,106 | 7/1957 | Koehler | 273/81.3 |
| 3,170,690 | 2/1965 | Goranson et al. | 273/77 |
| 3,679,207 | 7/1972 | Florian | 273/80 A |
| 3,918,721 | 11/1975 | Trask | 273/194 R X |
| 4,227,694 | 10/1980 | Drake | 273/164 |
| 4,265,448 | 5/1981 | Anderson | 273/75 X |
| 4,491,323 | 1/1985 | Kozub | 273/81 D |
| 4,605,228 | 8/1986 | Guendling, Jr. | 273/77 R |
| 4,805,911 | 2/1989 | Ferlazzo et al. | 273/162 R |
| 4,982,963 | 1/1991 | Fazio et al. | 273/81.4 |

*Primary Examiner*—George J. Marlo
*Attorney, Agent, or Firm*—Beaman & Beaman

[57] ABSTRACT

A golf putter suitable for use by either a right or left hand favored person employing the principle of the pendulum as its primary operating concept, is provided for putting in either a modified croquet style of putting or the conventional across the body style. The invention comprises a mallet portion consisting of a shaft having a head and a flexible universal pivot portion from which the mallet portion is suspended. A grip is provided on the shaft to aid in positioning the head face perpendicular to the desired direction of ball travel and the grip may be axially translatable along the shaft. The universal pivot portion comprises a pivot cord flexible in all lateral directions which extends from the elongated shaft's upper end having a finger grip attached to the pivot cord at its terminus. The flexible pivot cord, form which the putter mallet portion is suspended, acts as a universal pendulum fulcrum enabling the putter mallet portion to freely swing thereby allowing the putter head to accurately move along the intended line of the putter stroke.

8 Claims, 1 Drawing Sheet

PUTTER WITH PENDULUM ACTION

BACKGROUND OF THE INVENTION

1. Field of the Invention

The present application relates to golf clubs known as putters, having a substantially "T" shaped head connected to a shaft wherein the putter swings in a pendulum-like fashion during the putting stroke.

2. Description of Related Art

Putting principles are described U.S. Pat. Nos. 3,679,207 and 4,227,694. Each of the above inventions addresses one or several of the three most important elements of successful putting which are 1) orienting the putter head such that at the point of impact the head face is perpendicular to the desired path for the ball to travel, 2) impacting the ball at its centerline, and 3) swinging the putter with a smooth motion in line with the desired direction of ball travel.

U.S. Pat. No. 4,605,228 teaches that there are various problems related to putting which golfers have attempted to overcome in their search for the ultimate putter. This patent teaches several approaches that have been used to develop putters that accurately propel a golf ball to the cup. The putter configuration is used in a modified croquet style stance using the golfer's arm as part of a pendulum arm; and because of the short shaft length, the invention requires constant modification of the golfer's stance in order to use the putter for various length putts resulting in inconsistent results. Additionally, putters of this configuration require the golfer's body to guide the putter towards the ball when putting. The muscular action of guiding the putter towards the ball compounds the putting problems due to the difficulty in maintaining the putter head orientation relative to the ball and desired path of ball travel. This effect may result in the putter face striking on the ball at various points of impact.

U.S. Pat. No. 3,679,207 also teaches the use of a modified croquet style of putting using a long shaft putter. This long shaft putter helps the golfer by allowing the use of a similar stance and body/putter relationship under varying conditions. While the position and stance variation problems with putters used in a modified croquet style is alleviated by this configuration, the golfer's body has a tendency to twist as the putter is swung. This twisting results in a roundhouse swing at the ball which makes hitting the ball centerline with the putter face perpendicular to the desired path of ball travel very difficult to consistently accomplish.

Many of the aforedescribed problems are overcome by the pendulum type putters shown in U.S. Pat. Nos. 3,170,690 and 4,491,323. The putter of U.S. Pat. No. 3,170,690 uses a rigid shaft hinged to a rigid handle which, due to its employment of a pendulum-like principle, enables the golfer to more consistently impact the putter head at the ball centerline. While the putter is an improvement over non-pendulum putters, the bi-directional hinged construction uses a singular pivot axis which is difficult to align with the desired ball path. This construction also makes the ball roll distance difficult to control. The invention of U.S. Pat. No. 4,491,323 is also difficult to maintain in proper alignment. In this patent, the bearing faces located at the putter top have a singular pivot axis and must be in correct alignment with the desired ball path. Because of the small size of the club's gripping device, it is difficult to appreciate its alignment with the desired ball path; consequently, aiming the putter is relatively difficult.

OBJECTS OF THE INVENTION

In view of the foregoing considerations in golf putter fabrication, it is the aim of the invention to provide an improved pendulum style putter which is economical and simple to operate. It is a further object of the invention to provide a pendulum type of putter wherein the weight of the putter is supported by one hand and the direction of putter head movement is controlled by the other hand in a manner such that the golfer's hand movements are independent of each other and permit accurate putter head movement without external influence.

It is yet a further object of the invention to provide an improved pendulum type putter which will aid the golfer in maintaining the putter in a smooth motion in a single plane thereby enabling the golfer to more consistently impact the golf ball with the putter face perpendicular to the desired path of ball travel.

SUMMARY OF THE INVENTION

The putter of the invention employs the principle of the pendulum to aid the golfer in consistently impacting the golf ball at its centerline with the putter face perpendicular to the desired path of ball travel at the moment of impact and rolling the ball 6 along the desired path as determined by one of the golfer's hands. The putter of the invention comprises a universal pendulum support portion having no specific pivot axis and a supporting mallet portion. The pendulum support portion comprises a button-like finger grip attached to a flexible short pivot cord, which together with the finger grip, functions as a pendulum fulcrum. The pivot cord functions in the context of the invention as a low friction, universal pivot member capable of bending in all lateral directions with equal flexibility.

The putter mallet portion comprises a shaft having a head connected to the shaft lower end. The pivot cord is attached to the shaft upper end and allows the mallet portion, which functions as a pendulum arm with the head acting as the pendulum weight, to freely swing from the pivot cord.

The shaft can be constructed of any number of rigid materials of various configurations. Examples of three such embodiments described below are: 1) wherein the shaft is a single tubular steel shaft covered by a sheathing gripping surface, 2) wherein the shaft comprises a single rectangular steel tube with a sliding inverted "T" shaped shaft grip, and 3) wherein the shaft comprises two substantially parallel shafts passing within a sliding inverted "T" shaft grip. In the last two embodiments the grip is grasped by the golfer's putter guiding hand and the movement of the grip on its shaft provides a smooth motion during the putter stroke.

The weight of the putter is borne by the golfer's hand holding the pivot cord finger grip. The movement of the shaft and head is solely produced by the golfer's other hand. Thus the movement of the putter is only influenced by a single hand and a straight linear putter stroke can be readily achieved. Inaccuracies of putter movement due to uncoordinated two hand movements are thereby eliminated.

BRIEF DESCRIPTION OF THE DRAWINGS

In order that the invention may be clearly understood, it will now be described, by way of example, with reference to the accompanying description and drawings, wherein.

DESCRIPTION OF THE PREFERRED EMBODIMENTS

Figure 7:
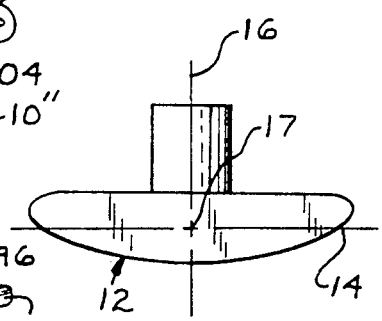
FIG. 7 is a detail view of the pendulum putter head.

Referring more specifically to the drawings, the numeral 10 generally designates a pendulum golf putter for propelling a golf ball. The putter may be used by either a right hand favored person or a left hand favored person and includes a substantially "T" shaped head 12 having a longitudinal axis 14, a central axis 16 and a center 17, FIG. 7. The head 12 is connected to a shaft 18, which together constitute a putter mallet portion 20 which is adapted to be suspended by a flexible pivot portion 22 comprising a flexible pivot cord 24 having a disc-like finger grip 26 at the cord's terminus secured by an eyelet 28.

Figure 4:
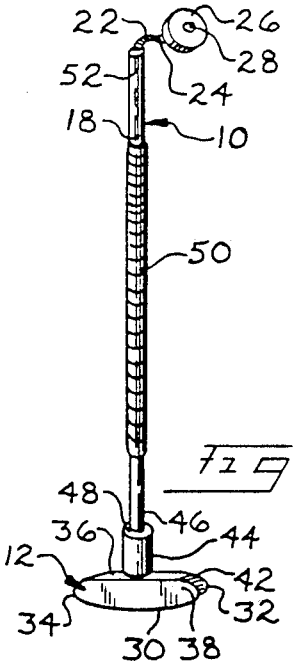
FIG. 4 is an elevational perspective view of the pendulum putter preferred embodiment in accord with the invention.

As shown in FIG. 4, the metal head 12 is symmetrical about the central axis 16 and comprises: 1) a longitudinally convex putter head bottom constituting a shoe 30 which arcuately rises from the head central axis 16 to intersect a radiused head first end 32 and a radiused second head end 34; 2) a substantially planar putter head top 36 which extends from the putter head first end 32 to the head second end 34; 3) a putter head face 38 defined by the transverse head shoe 30 in conjunction with the head ends 32 and 34, head top 36 and a planar head back 42 which is parallel to the head face 38; and 4) a columnar hosel 44 defined in the putter head 12 along the head central axis 16 having a shaft connection means 48 in the form of a hole symmetric about the head central axis 16 adapted to receive the shaft lower end 46. The putter head weight is balanced about the central axis 16 to provide consistent and predictable performance.

In the embodiment of FIG. 4, the putter hosel 44 is adapted to receive a single round shaft 18. The shaft 18 of this preferred embodiment extends outward from the head 12 and is partly covered with a sleeve 50 of conventional golf club grip material which extends upwardly along the shaft towards the shaft upper end 52. The shaft 18 of the preferred embodiment is of seamless tubular steel construction. Its lower end is joined with the head 12 by means of insertion into the closely fitting hole 48 defined in the head hosel 44 and bonded to the head by means of an adhesive resin or the like.

Coaxially attached to and extending from the shaft upper end 52 is a flexible pivot cord 24 of a relatively short length such as one inch. The cord 24 is formed of cotton or plastic filaments, preferably woven, and must be equally flexible in all lateral directions. The outer end of the cord 24 passes through the eyelet 28 of the disc-like finger grip 26 whereby the putter 10 can be supported in pendulum-like manner by inserting the cord 24 between the golfer's fingers so that the grip 26 engages the inside of the fingers.

Figure 5:
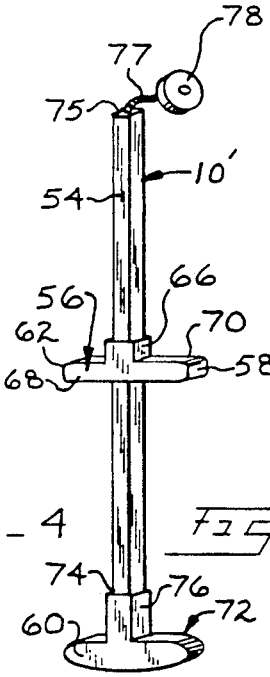
FIG. 5 is an elevational perspective view of a first alternative embodiment of the pendulum putter in accord with the invention.

A first alternate embodiment of the pendulum putter in accord with the invention principles is illustrated in FIG. 5 as shown at 10'. FIG. 5 shows a square, single shaft 54 with an inverted "T" shaped sliding shaft handle 56 mounted on the shaft 54. The shaft handle 56 is symmetrical about the shaft longitudinal axis, slidingly, coaxially mounted on the shaft 54 having a rounded first end 58, a rounded second end 62 and a central extension 66 rising parallel with the shaft 54 having a central through going hole complementarily shaped to receive the shaft 54 which prevents rotational movement of the shaft handle 56 relative to the shaft 54. Both the front planar handle face 68, and rear planar handle face 70 are parallel to the putter head face 60 and back 64, respectively, and thereby aid in aligning the putter head 72 perpendicularly in relation to the desired path of ball travel. The first alternate embodiment's shaft lower end 74 is fixedly inserted into a complementarily shaped opening in the putter head's hosel 76 in a manner similar to that of the preferred embodiment. As in the preferred embodiment, a pivot cord 77 is concentrically mounted in the shaft 54 upper end 75. While somewhat less strong and less economical than the preferred embodiment, this construction offers improved control of the putter head face 60 relative to the desired ball path due to the shaft handle configuration. Furthermore because the handle finger grip 78 rests in the fingers of the golfer's second hand 80, by holding the shaft loosely in one's first hand fingers 84, and locking one's first arm elbow 86 while guiding the putter 10', a smooth linear motion may be imparted to the putter head as the mallet portion pivots on the pivot cord 77.

Figure 6:
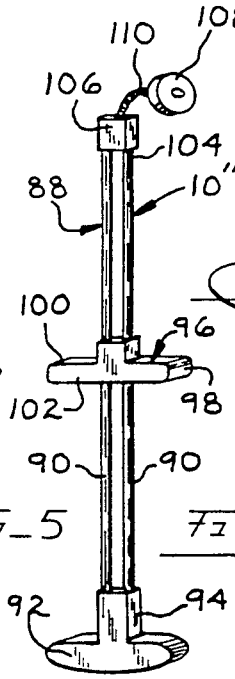
FIG. 6 is an elevational perspective view of a second alternative embodiment of the pendulum putter in accord with the invention.

A second alternate pendulum putter embodiment 10'' is illustrated in FIG. 6. As illustrated, the shaft 88 is comprised of two parallel tubular rods 90 rising symmetrically about the putter head central axis describing a plane parallel to the putter head face 92 plane. Complementary, symmetrically oriented holes are located in the head hosel 94 which are adapted to fixedly receive the rods 90 which are secured therein by a bonding means such as welding or an adhesive resin. The employment of tubular shafts provides increased strength and reduces the putter weight as compared with the single square shaft embodiment of FIG. 5.

The second alternate putter embodiment 10'', includes an inverted "T" shaft grip 96. The shaft grip 96 differs from that of the first alternate putter embodiment 10, only in that it has two throughgoing holes parallel to and symmetrical about the shaft longitudinal axis, complementarily adapted to slidingly receive the rods 90 as opposed to having a single central square hole. The sliding shaft grip 96 includes rounded first end 98 and a rounded second end 100 and a front face 102 which is parallel to the putter head face 92 plane and functions in the same manner as the sliding shaft grip 56 of the first alternate embodiment 10'. The shaft second end 104 is terminated by a cap 106 bonded to the parallel shafts 90. The cap 106 serves dual purposes: first, the cap 106 aids in maintaining the parallel relationship of the two rods; second, because lateral balance is essential to the proper operation of the putter, it is necessary to install the pivot cord 110 concentrically with the putter central longitudinal axis. This is facilitated through employment of the cap 106 which has a central hole adapted to closely receive and secure the pivot cord 110. Finger grip 108 is attached to the end of the pivot cord 110 in the manner described above.

The pivot cord 24,77 or 110 may be formed of any number of flexible natural or man made materials, the primary criterion for selection being its uniform ease of bending in all directions. The uniform lateral flexibility of the cord material is especially important because the pivot cord functions as a low resistance universal pivot which permits the putter to be swung in any selected direction without influencing the putter's swing path. Furthermore, because the handle finger grip 26,78 or 108 rests in the fingers of the golfer's second hand 80, by holding the shaft loosely in the golfer's first hand fingers 84, and locking one's first arm elbow 86 while guiding the putter, a smooth linear motion may be imparted to the putter head 12 as the mallet portion pivots on the pivot cord.

Figure 1:
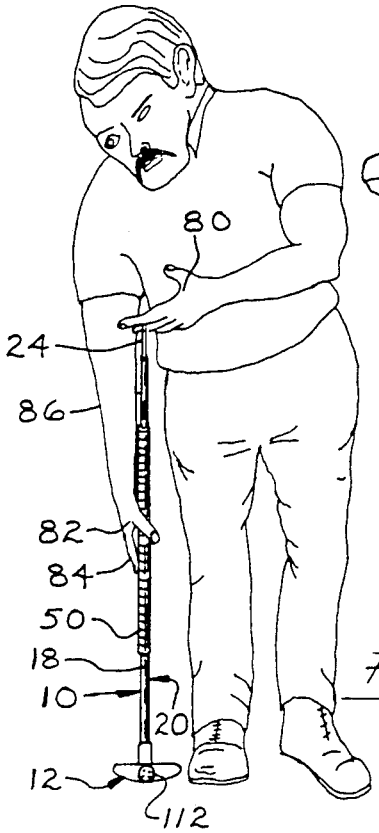
FIG. 1 is an elevational view of the pendulum putter of the invention as employed in putting a golf ball.
Figure 2:
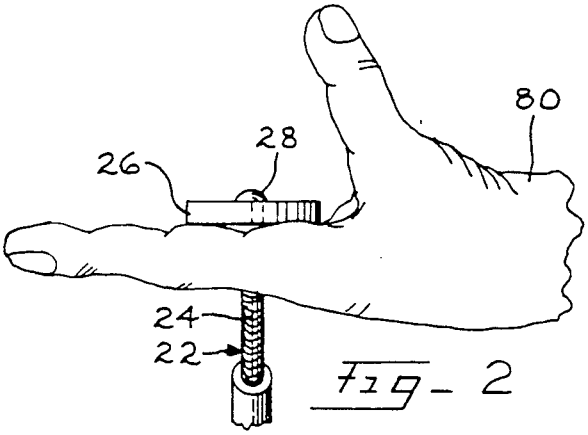
FIG. 2 is a detail, enlarged elevational view of the pendulum putter handle finger grip, pivot cord and golfer's hand in accord with the invention.
Figure 3:
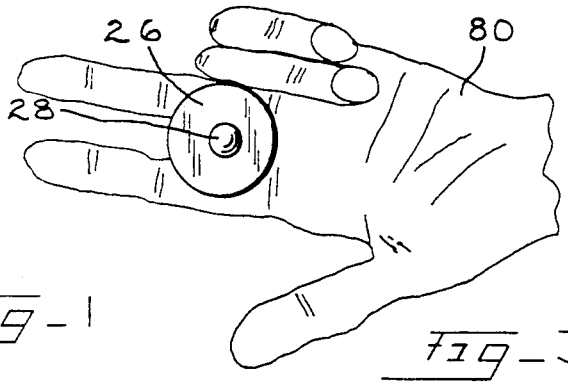
FIG. 3 is a plan, enlarged, detail view of the pendulum putter finger grip as it rests in a golfers hand in accord with the invention.

In using the embodiment of FIGS. 1–4, for a right golfer, the finger grip 26 is typically placed between the golfer's second and third or third and fourth digits of the left hand 80. The putter 10 is thereby suspended while the right hand 82 grasps the sleeve 50 and guides the putter face 38 until it is perpendicular to the desired ball path as shown in FIG. 1. The putter head 12 is then positioned such that the face center 17 is adjacent the ball center line and so that the putter hangs to the rear of the ball 112 with gravity causing the putter to be perfectly vertical as it hangs. Next, the right hand 82, positioned on the shaft sleeve grip 50, draws the putter 10 back in a line which is a continuation of the desired ball path while at the same time maintaining the transverse relationship between the putter face 38 and the chosen ball path. After the shaft 18 is drawn back as far as desired the putter 10 is moved forwardly by hand 82 and while being lightly guided is allowed to naturally swing along the chosen path while suspended by cord 24 which acts as a pendulum fulcrum and support. Upon the head 12 striking the ball 112, the putter causes the ball 112 to be deflected in the desired path off the putter head face 38.

During the putting process, the left hand 80 supporting the finger grip 26 is steadied by pressing the golfer's left forearm, wrist and hand area to the body to stabilize the fulcrum anchor formed by the union of the finger grip 26 and the pivot cord 24. This technique aids the putter in swinging in a single plane thereby enhancing the stability, accuracy and predictability of the putting.

The putter embodiments 10' and 10'' of FIGS. 5 and 6, respectively, are used in the same manner as described above, except that the golfer's right hand 82 engages the grip 56 or 96 rather than the sleeve 50. Upon grasping the grip 56 or 96 the golfer aligns the head surface 60 or 92, respectively, with the ball and perpendicular to the desired path of ball movement. As the golfer uses the right hand 82 to draw the shaft backward and move the same forwardly during the putting stroke a uniform hand engagement with the grips 56 or 96 can be maintained at all times and any relative change that occurs between the axial position of hand 82 to the shaft 54 or 88 during the putting process will be accommodated by the axial sliding of the grip on the associated shaft providing a smooth and uniform movement of the putter.

It is within the scope of the invention to fix the grips 56 and 96 upon their respective shafts, if desired, to prevent a relative sliding action. In such instances the grips are used to align the head with the ball and aid in controlling the plane of the putter movement.

With the putter of the invention the entire weight of the putter will be carried by the flexible cord and the golfer's one hand supporting the cord. The golfer's other hand is used solely to move and direct the putter motion. Since only one hand and arm are used to control the direction and speed of the putter movement a more accurate control of the putter is achieved than would be obtainable with putters whose movement is produced by two hands and arms. The use of the putter of the invention putter does not require the degree of two handed coordination required by conventional putter constructions.

Further, the improved accuracy achieved by the putter of the invention is also a result of the natural instincts to swing the putter shaft in a single plane with a "underhanded" motion which produces a natural follow-through and enables the golfer to primarily keep his eyes on the hole instead of the ball during the stroke after taking the putting stance because of the simplicity and steadiness of the body stance during stroking, which further improves accuracy.

It is appreciated that various modifications to the inventive concepts may be apparent to those skilled in the art without departing from the spirit and scope of the invention.

I claim:

1. A golf putter for propelling a golf ball, comprising, in combination, an elongated rigid shaft having a central longitudinal axis and lower and upper ends, a head mounted upon said shaft lower end having a ball engaging face, said shaft and head constituting a pendulum arm, a short flexible pivot cord coaxially attached to said shaft upper end, a finger grip mounted upon said pivot cord spaced from said shaft upper end, pivot cord connection means attaching said finger grip to said pivot cord, said pivot cord being uniformly laterally flexible in all lateral directions and constituting a universal pendulum support for said pendulum arm when said pendulum arm is supported by said finger grip and said cord.

2. In a golf putter as in claim 1, wherein said finger grip comprises a substantially cylindrical plate having a central opening adapted to receive said pivot cord.

3. In a golf putter as in claim 1, wherein said elongated shaft comprises a single elongated cylindrical shaft.

4. In a golf putter as in claim 3, hand grip means for controlling said putter head orientation relative to the desired golf ball path, said hand grip means closely conforming to and surrounding said shaft.

5. In a golf putter as in claim 1, wherein said elongated shaft comprises a single elongated rectangular shaft.

6. In a golf putter as in claim 5, a shaft handle slidably mounted on said shaft and a planar face defined on said handle parallel with said head face for aligning said head ball engaging face with the ball.

7. In a golf putter as in claim 1, wherein said shaft comprises plural, substantially parallel elongated shafts, said plural shafts extending from said head substantially parallel to and symmetrically related to said shaft central axis.

8. In a golf putter as in claim 7, a shaft handle slidably mounted upon said shafts and a planar face defined on said handle parallel with said head face for aligning said head ball engaging face with the ball.

* * * * *